US006327822B1

(12) United States Patent
Il Grande

(10) Patent No.: US 6,327,822 B1
(45) Date of Patent: Dec. 11, 2001

(54) MODULAR PREFABRICATED ELEMENT USED IN BUILDING CONSTRUCTION

(75) Inventor: Roberto Il Grande, Pordenone (IT)

(73) Assignee: Daliform S.R.L, Pordenone (IL)

( * ) Notice: Subject to any disclaimer, the term of this patent is extended or adjusted under 35 U.S.C. 154(b) by 0 days.

(21) Appl. No.: 09/347,415

(22) Filed: Jul. 6, 1999

(30) Foreign Application Priority Data

Jul. 3, 1998 (IT) ..... PN98A0049

(51) Int. Cl.[7] ..... E04B 1/32
(52) U.S. Cl. ..... 52/80.1; 52/577; 52/687
(58) Field of Search ..... 52/80.1, 81.2, 52/687, 576, 577; 249/175, 183, 64

(56) References Cited

U.S. PATENT DOCUMENTS 3,299,585 * 1/1967 Wilkins ..... 52/80.1 X
3,352,079 * 11/1967 Strong ..... 52/577
3,899,153 * 8/1975 Friedl ..... 249/65
4,128,975 * 12/1978 Abate ..... 52/125
4,495,744 * 1/1985 Carl ..... 52/577
4,702,048 * 10/1987 Millman ..... 52/169
5,067,686 * 11/1991 Peterson ..... 249/57
5,505,564 * 4/1996 Verstraeten ..... 405/267
5,555,693 * 9/1996 Sorkin ..... 52/687 X
5,797,230 * 8/1998 Lassen ..... 52/576 X
6,089,522 * 7/2000 Haslem et al. ..... 52/687 X

* cited by examiner

*Primary Examiner*—Bruce A. Lev
(74) *Attorney, Agent, or Firm*—Wenderoth, Lind & Ponack, L.L.P.

(57) ABSTRACT

A building construction element is used to form cast concrete interspaces in a concrete slab. The element has a bowl shaped portion which has a concave upper surface forming substantially a catenary as seen in vertical section. Supports are connected with the bowl shaped portion and extend downward relative to the bowl shaped portion.

11 Claims, 5 Drawing Sheets

MODULAR PREFABRICATED ELEMENT USED IN BUILDING CONSTRUCTION

BACKGROUND OF THE INVENTION

1. Field of the Invention

The present invention relates to a modular prefabricated element used in building construction, particularly used for making floors and related slabs with cast concrete interspaces.

2. State of the Prior Art

It has been known for a long time to provide aerated hollow spaces, also called interspaces, under the floors of residential and commercial buildings for the purposes of eliminating gases and humidity which can damage both people and the building structures.

A modern and rational solution to the problem of eliminating the humidity and gases is described in Italian patent specification 1,253,374 and in Italian design application no. PN93 0 000012, both of the present applicant. The solution of these documents is a modular element that is preferably molded out of a plastic material in the shape of a spherical cap. It is provided with four supports that are connected to each other by four arches. The side edges of the arches are shaped so as to enable contiguous elements to be joined to each other, due to respective edges being able to overlap and snap-fit together. The contiguous elements can then form a solid and continuous surface.

The prior art element described above, however, needs to be provided with reinforcing, i.e. stiffening ribs, in particular under the cap, so as to ensure that the surface is able to carry and withstand, without any problem, both the weight of the workers as the prior art element is installed, and the weight of the subsequent concrete casting. The prior art structural element is thus subject to both compressive and flexural stresses.

As a result, construction of the mold that is used to manufacture the prior art element is complicated, with a corresponding high cost. Furthermore, the prior art element itself, when made of molded plastic material, tends to be insufficiently resistant and unstable as a whole.

SUMMARY OF THE INVENTION

Accordingly, it is a primary object of the present invention to provide a modular element for forming aerated hollow spaces, or interspaces, in building construction applications which not only ensures unaltered functional properties, but also allows for a lower material usage and a simpler and more rational molding process than the prior art element. It is a further object of the present invention to provide such an element that is capable of being easily adapted, with respect to both its shape and size, to a particular user application requirement.

The objects of the present invention are achieved by the provision of the modular prefabricated element which has a bowl shape structure with an upper surface that is concave, symmetrical and substantially a catenary in vertical section. Resting supports are connected with the bowl shaped structure. Further, a frusto-conically shaped lateral surface forms a circular junction with the bowl shaped structure, the circular junction lying in a horizontal plane. The resting supports are connected with the frusto-conically shaped lateral surface so that the upper surface has a smaller radius than the resting supports. Upon the application of a vertical load to the upper surface, the upper surface is only subjected to radial tensile stresses.

The bowl shaped portion, the frusto-conically shaped surface and the resting supports are preferably molded in one piece and thus unitary. The supports are essentially formed by extending the frusto-conically shaped surface downward from the bowl shaped portion at a plurality of points circumferentially spaced along the bowl shaped portion. The supports end in horizontal feet, and are essentially defined by arched spaces therebetween. Bent edges along the arched spaces along vertical planes are capable of overlapping and fitting together with like bent edges.

BRIEF DESCRIPTION OF THE DRAWINGS

Further objects, features and advantages of the present invention will become clear from the following description of preferred embodiments of the present invention with reference to the accompanying drawings, in which.

DETAILED DESCRIPTION OF THE PREFERRED EMBODIMENTS

Figure 2:
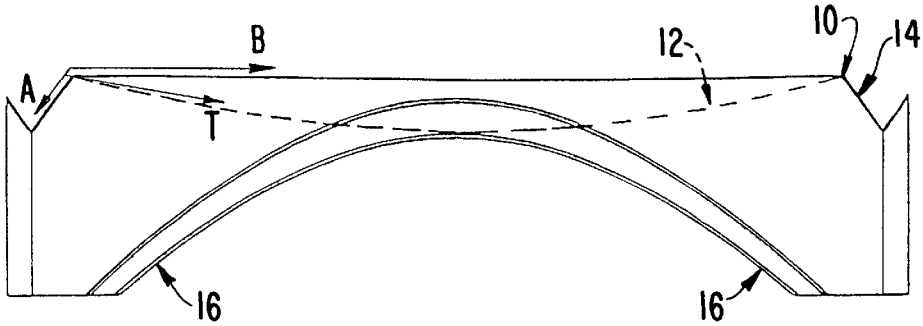
FIG. 2 is a schematic side view of a modular prefabricated element according to the present invention illustrating the resolution of forces acting under load conditions.
Figure 3:
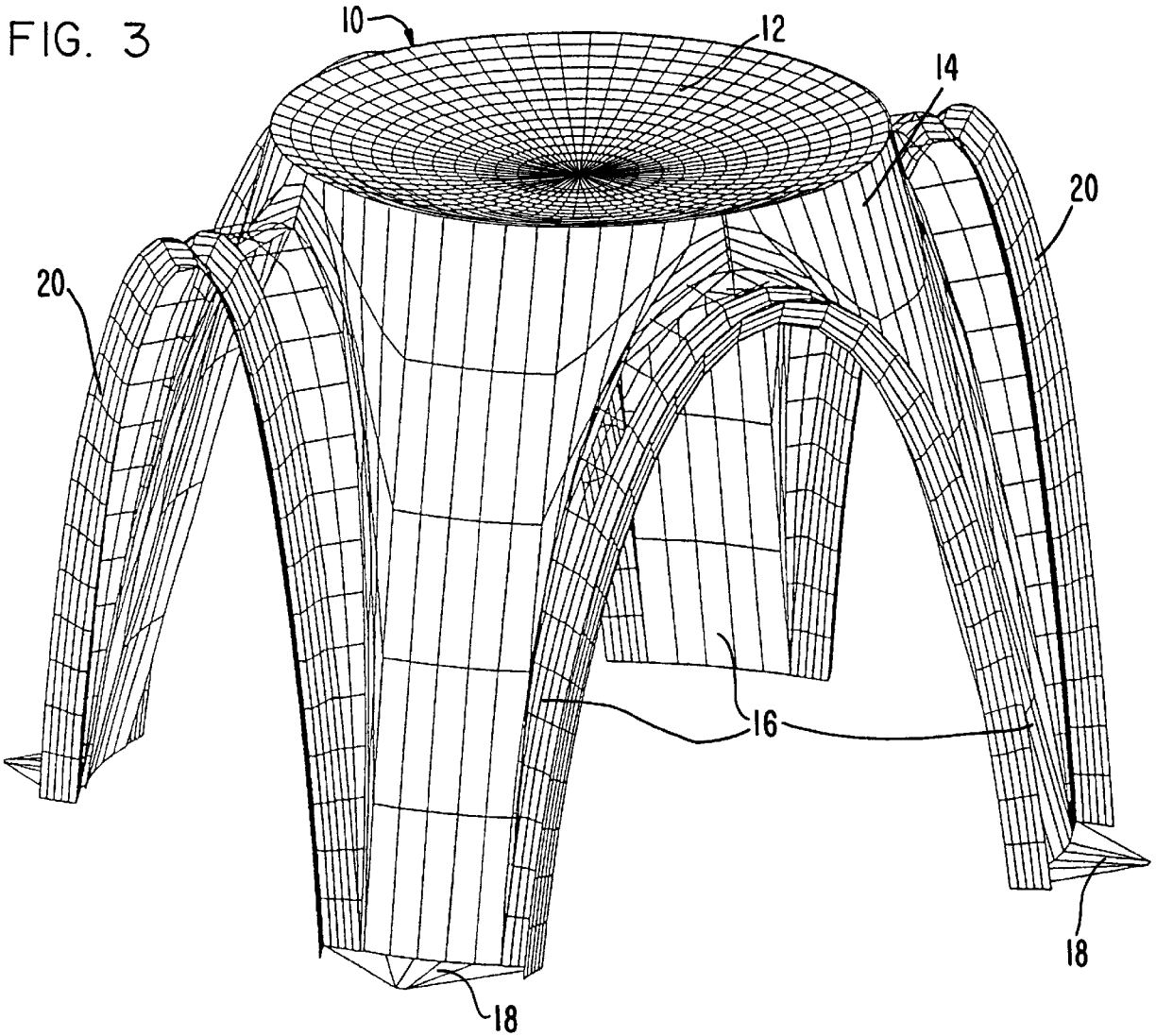
FIGS. 3 to 6 are perspective views of various embodiments of the modular prefabricated element according to the present invention.
Figure 4:
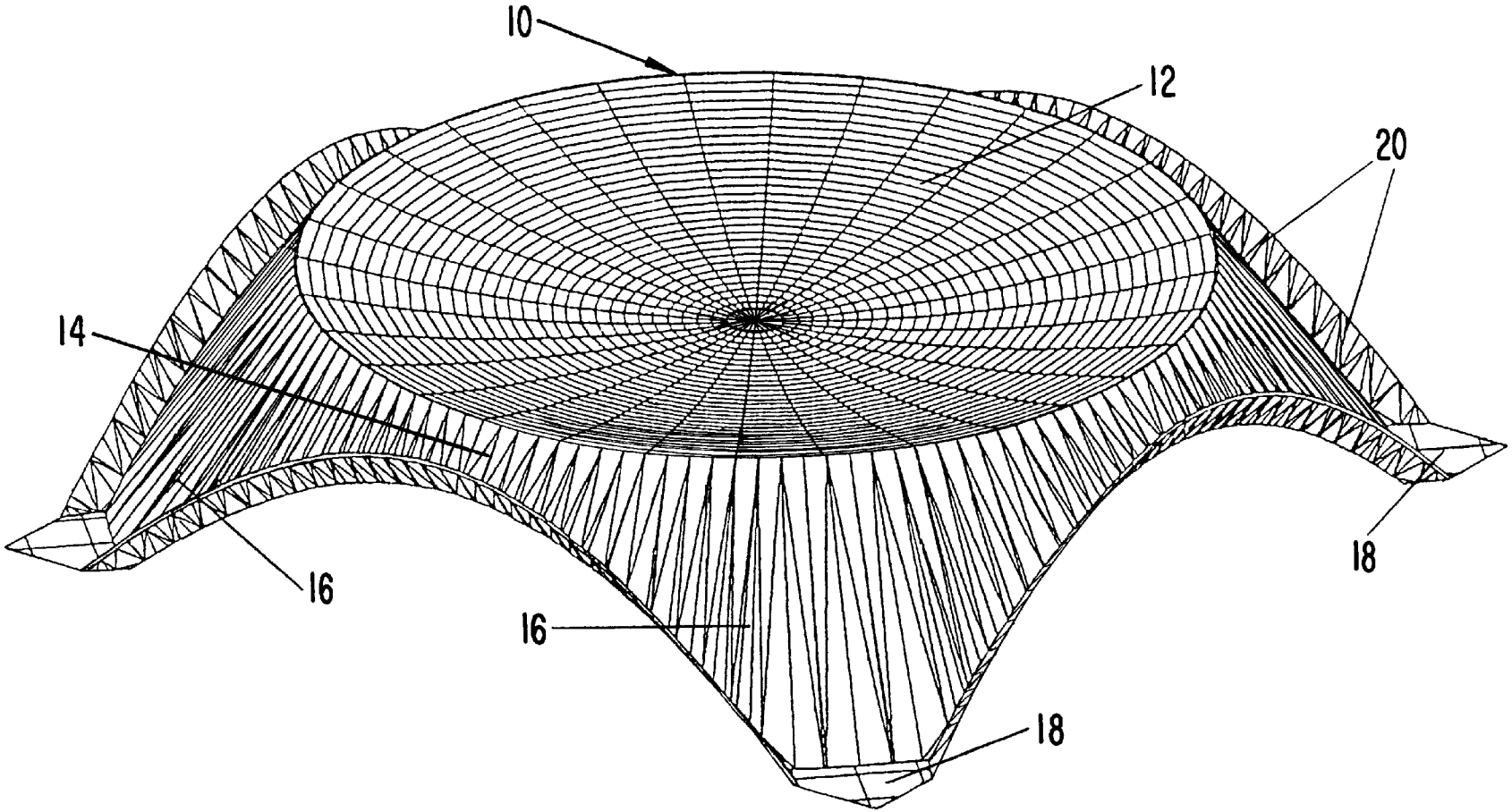
Figure 5:
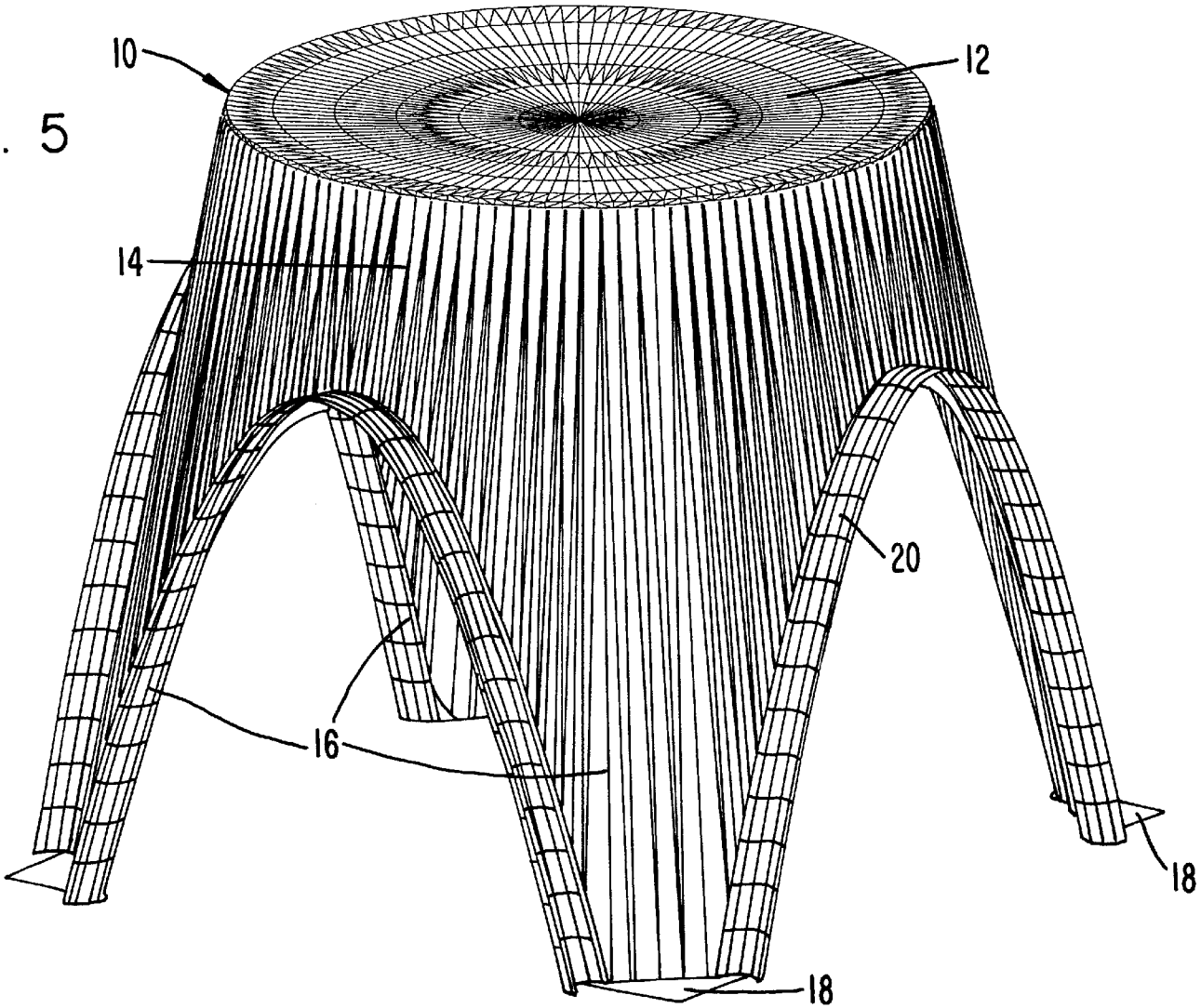
Figure 6:
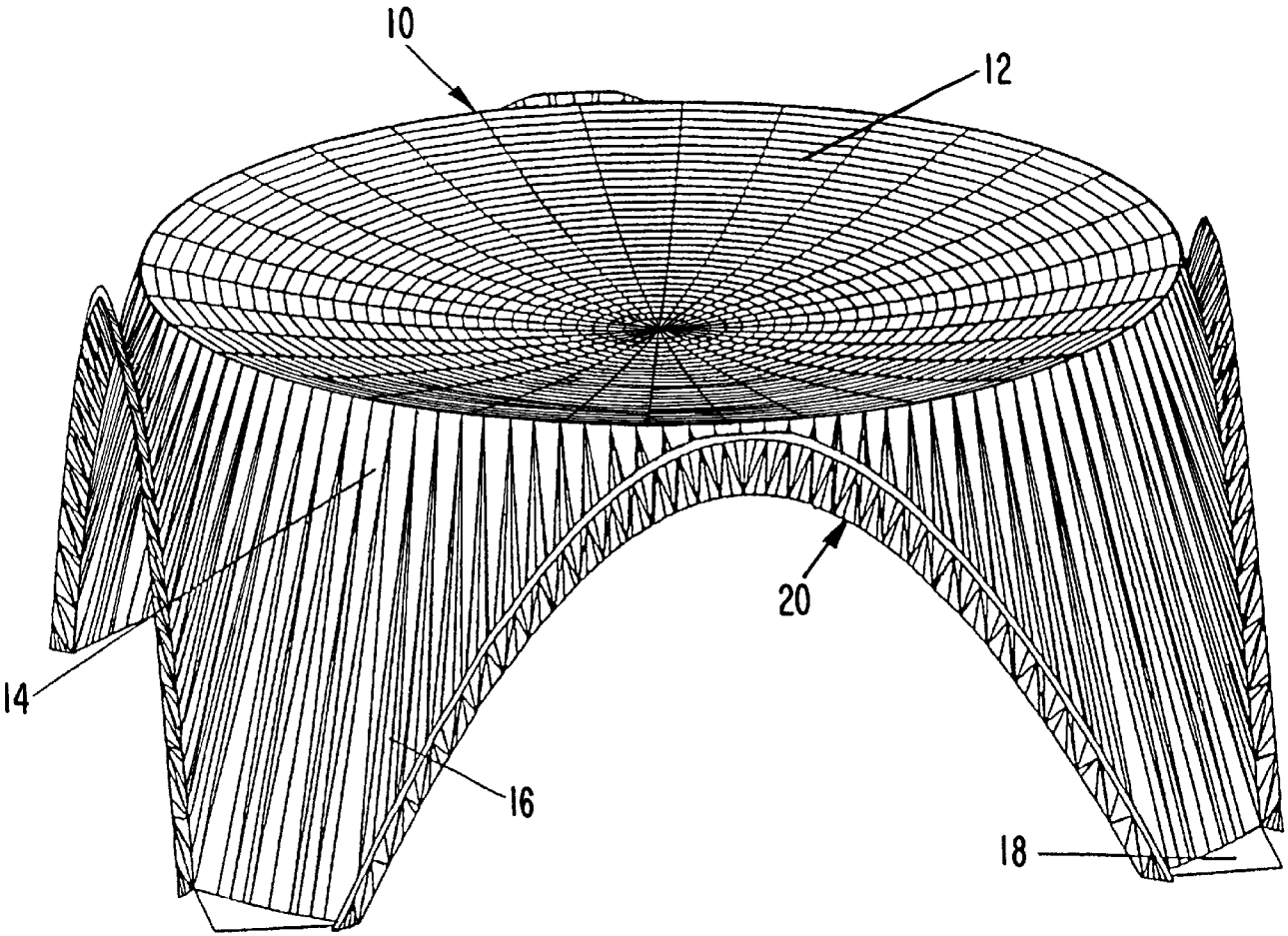

A prefabricated modular element according to the present invention is formed with a cap-like structure having supports enabling the structure to rest on the floor. Referring to FIG. 2, the element itself includes a cap portion or bowl shaped structure 10 having an upper surface 12 that is concave and symmetrical. As seen in vertical section, noting for example the dashed line in FIG. 2, the upper surface is substantially a catenary. The outer edge of the surface of the cap portion is circular and lies on a horizontal plane.

Figure 1:
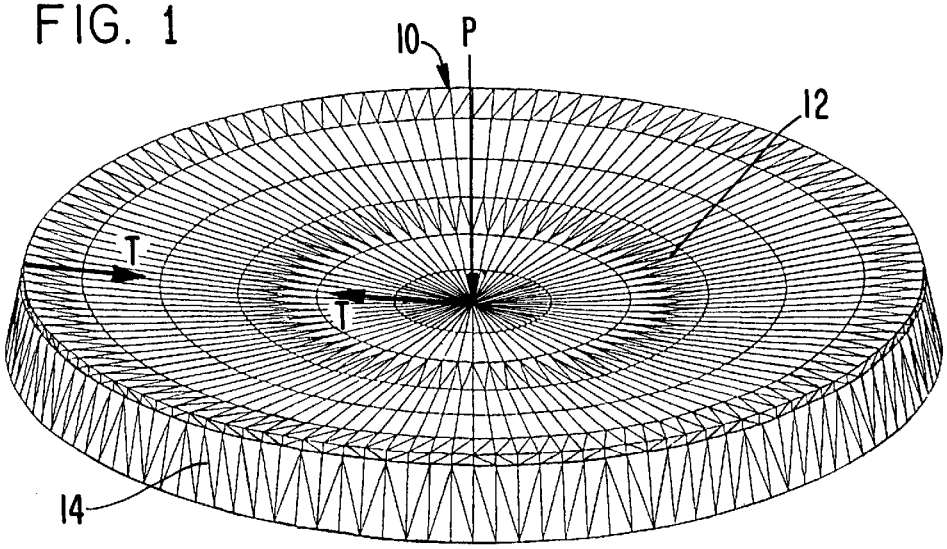
FIG. 1 is a perspective view of a cap portion of an element according to the present invention.

The prefabricated modular element according the present invention will support loads that bear down on the element, for example due to the weight of a worker during installation of the element itself, and the mass of concrete that is cast to form the slab. In FIG. 1, these loads are indicated by P, and are considered as being ideally applied to the center of the surface 12.

The particular conformation of the cap portion 10 converts these loads into tensile stresses T that develop radially, tangentially to the surface 12. These stresses are exactly balanced where the surface 12 is circular and horizontal. This allows for the amount of material that is needed to manufacture the modular prefabricated element to be reduced, because the element itself does not work flexurally. That is, it does not undergo flexural stresses, but rather behaves like a membrane, and is only subjected to tensile stress.

The surface 12 intersects a lateral surface 14 that is preferably in the shape of the frustum of a cone. The lateral surface 14 extends downwards with supports 16 as shown in FIGS. 2–6 in order for the element to rest on the floor. With respect to the frustum of a cone formed by the lateral surface 14, the surface 12 forms the smaller base thereof. This arrangement allows for a greater capability of the modular prefabricated elements to be piled in stacks. This also enables the height of the cap portion 10 to be reduced, enabling the free height of the hollow space, or interspace, to be correspondingly increased.

At the intersection or junction point of the surfaces 12 and 14, the tensile stresses T breakdown into two forces as shown in FIG. 2. A force A is directed according the generatrix of the cone, i.e. according the lateral surface 14, and the force B is directed toward the center of the cap portion and lies on the horizontal plane containing the contour. The forces A resolve onto the resting plane or surface of the modular prefabricated element through the supports 16. The forces B tend to compress the contour, which is therefore practically only subject to compressive stress.

FIGS. 3 to 6 illustrate various specific embodiments of the modular prefabricated element according the present invention. Each of these embodiments has supports 16 mutually connected through side arches that create through flow or passage apertures for discharging gases and humidity. They could also possibly be for the passages of cables and conduits therethrough. The supports 16 have a cross section that is inclined according to the conical shape of the lateral surface 14 of the modular prefabricated element. This allows the plurality of the elements to be superimposed or stacked in an optimum manner, allowing their volume to be reduced during storage and transport.

The supports 16 are provided with feet 18 through which they actually rest on the floor. The connecting arches have bent edges 20 extending along substantially vertical planes. The bent edges 20 allow for contiguous elements to be joined to each other by overlapping and snap-fitting the bent edges 20 together. The feet 18 preferably have a triangular shape so that the feet of four contiguous elements are able to form a complete and solid square base.

Accordingly, when concrete is poured over a surface of appropriately joined modular prefabricated elements as described above, the concrete is able to percolate along the shaped supports 16. By solidifying, the concrete forms actual pillars between the shaped supports 16 of different elements. Compared with prior art arrangements, the present invention allows for a smaller amount of concrete to be used for forming the floor or slab for the same useful height of the interspace or hollow cavity.

Furthermore, with the modular prefabricated element according to the present invention, no reinforcing ribs are required to be provided. This allows the modular prefabricated elements to be more inexpensive and simpler to mold.

Those with skill in the art will appreciate that the modular prefabricated element according to the present invention can be subject to a number of possible modifications and variations from the above-described embodiments without departing from the scope of the invention as defined by the appended claims.

I claim:

1. A modular prefabricated element comprising a bowl shaped structure having resting supports connected therewith, wherein said bowl shaped structure has an upper surface that is concave, symmetrical and substantially a catenary in vertical section, and wherein a frusto-conically shaped lateral surface forms a circular junction with said bowl shaped structure, said circular junction lying in a horizontal plane.

2. The modular prefabricated element of claim 1, wherein said resting supports are connected with said frusto-conically shaped lateral surface such that said upper surface has a smaller radius than said resting supports.

3. The modular prefabricated element of claim 1, wherein said upper surface of said bowl shaped structure is arranged such that, upon the application of a vertical load to said upper surface, said upper surface is only subject to radial tensile stresses.

4. A building construction element for use in forming cast concrete interspaces, said building construction element comprising:

a bowl shaped portion comprising a concave upper surface forming substantially a catenary as seen in vertical section;

supports connected with said bowl shaped portion extending downward relative to said bowl shaped portion; and a lateral portion having a frusto-conically shaped surface, said frusto-conically shaped surface of said lateral portion joining said concave upper surface of said bowl shaped portion at a circular junction lying in a horizontal plane.

5. The building construction element of claim 4, wherein said supports are connected with said lateral portion such that said supports extend radially outward as they extend downward so as to have a larger radius at a lower end thereof than said concave upper surface.

6. The building construction element of claim 4, wherein said bowl shaped portion, when subjected to a vertical load on said concave upper surface, only develops radial tensile stresses.

7. The building construction element of claim 4, wherein said bowl shaped portion, said frusto-conically shaped surface and said supports are unitary.

8. The building construction element of claim 7, wherein said supports are formed by extending said frusto-conically shaped surface downward from said bowl shaped portion at a plurality of points circumferentially spaced along said bowl shaped portion.

9. The building construction element of claim 8, wherein said supports end in horizontal feet.

10. The building construction element of claim 8, wherein said supports are defined by arched spaces therebetween.

11. The building construction element of claim 10, and further comprising bent edges along said arched spaces along vertical planes, said bent edges being capable of overlapping and fitting together with like bent edges of another building construction element.

* * * * *